US007308952B2

(12) United States Patent
Strazhgorodskiy

(10) Patent No.: US 7,308,952 B2
(45) Date of Patent: Dec. 18, 2007

(54) UNDERBALANCED DRILLING METHOD AND APPARATUS

(76) Inventor: Semen Iosiphovich Strazhgorodskiy, 144 B Belwood Ct., Los Gatos, CA (US) 95032

( * ) Notice: Subject to any disclaimer, the term of this patent is extended or adjusted under 35 U.S.C. 154(b) by 172 days.

(21) Appl. No.: 10/861,077

(22) Filed: Jun. 4, 2004

(65) Prior Publication Data

US 2005/0269134 A1 Dec. 8, 2005

(51) Int. Cl.
*E21B 43/00* (2006.01)

(52) U.S. Cl. ..... 175/65; 166/372

(58) Field of Classification Search ..... None
See application file for complete search history.

(56) References Cited

U.S. PATENT DOCUMENTS 5,896,924 A 4/1999 Carmody et al.
6,622,791 B2 * 9/2003 Kelley et al. ..... 166/313

FOREIGN PATENT DOCUMENTS

SU 979616 12/1982

OTHER PUBLICATIONS

Nina.M.Rach, "Underbalanced, near-balanced drilling are possible off shore", Oil&Gas Jornal, Week of Dec.!, 2003,pp. 39-44, PennWell, U.S.A.

* cited by examiner

*Primary Examiner*—Jennifer H. Gay
*Assistant Examiner*—Kerry W. Leonard

(57) ABSTRACT

A method of drilling well bore (20) through and below permeable formation (22) bearing such fluids as gas, oil, water wherein drill cuttings may be evacuated by formation fluid (23) being produced through the drill string (26) either by decreasing well head back pressure or by gas lift. Production rate is kept substantially stable by operating choke valves (140) and (142) placed after separator (52). Formation fluid being produced while drilling may be pumped into well bore (20) through annulus (31) or utilized. The unique injector included in the drill string provides for possibility to pump simultaneously into annulus (31) lifting gas and produced liquid and may be operated from the surface. A method and system (90) comprising a plurality of special 3-way valves included in drill string (26), are provided for making connections without interrupting flushing the well bore.

18 Claims, 9 Drawing Sheets

UNDERBALANCED DRILLING METHOD AND APPARATUS

CROSS REFERENCES TO RELATED APPLICATIONS

Not Applicable

FEDERALLY SPONSORED RESEARCH AND DEVELOPMENT

Not Applicable

BACKGROUND OF THE INVENTION

1. Field of the Invention

The present invention relates to drilling subterranean well bores, specifically to improved under balanced method and apparatus for drilling a well bore through or below a permeable formation containing such fluids as oil, gas, and water.

2. Description of the Related Art

Drilling a well bore typically requires circulating a drilling fluid to flush the bore of cuttings produced by action of a drill bit. The drilling fluid may be pumped down the well inside the drill string and, with picked up cuttings, back to the surface through the annulus outside the drill string. In another form, known in the art as reverse circulation, the drilling fluid is pumped through sealed annulus between a casing and the drill string, and drill cuttings are evacuated through the drill string.

Traditional drilling techniques maintain hydrostatic pressure of the drilling fluid in the well bore higher ("overbalanced") with respect to the formation pore pressure. In this overbalanced situation, materials are added to the drilling fluid to restrict fluid flow into formation by depositing low permeability filter cake on the borehole wall. Overbalanced drilling prevents formation fluid blowouts. But in certain conditions the drilling fluid flows into permeable formation and circulation may be partially or completely lost. Lost circulation is a costly problem. The production formation may be damaged by invading drilling fluid.

Under balanced drilling (UBD) has been introduced to avoid the shortcomings of the overbalanced drilling. Under balanced drilling is a technique wherein the pressure in an open section of the borehole is intentionally maintained below the formation pressure such that formation fluid flows into the well bore while drilling. Typically formation fluid flowing into the well bore is circulated to the surface with a drilling fluid pumped into the well bore.

Drilling fluids in major under balanced drilling techniques comprise gases, hydrocarbon liquids, water, mixtures of gaseous and liquid phases, foams.

Many UBD operations in depleted fields and in developing lower-permeability reservoirs are successful. But drilling long vertical intervals or horizontal sections in highly permeable formations, especially with cavities and fractures, remains a serious problem. Partial and full lost circulation is often encountered in such conditions. Loss control materials (LCM) are used to regain circulation. Sometimes drilling continues without returns. LCM and cuttings pumped into the formation while drilling without returns may plug the best pay zones, defeating, at least partially, the main goal of under balanced drilling.

In prolific formations UBD drilling fluids can transport to the surface tremendous volumes of fluids. If operator is not ready to treat and utilize the produced oil, UBD can't be implemented. Gas is typically flared at rates often exceeding 5 MMcfd. Water disposal may easily become a costly or prohibitive problem.

In UBD operations the well bore returns tend to be unstable in composition, pressure and rate. The returns may comprise a base drilling liquid, an added gas, drill cuttings, oil, natural gas, formation water, surfactants. The more productive is a formation the more unstable is the wellhead flow as a very small change in the drilling fluid circulating pressure leads to dramatic changes in formation fluid influx rate. It is difficult and costly to handle the unstable wellhead stream, especially if formation fluid is natural gas. Unstable wellhead stream requires separating equipment of big volumes and foot prints.

Many problems in UBD techniques arise in periods of pump off for making connections. The downhole pressure during resuming circulation usually exceeds the formation pressure allowing some volume of drilling fluid to enter the formation and damage it. Prolific liquid producers can kill themselves during times of pump off and often circulation cannot be reestablished. Connections in UBD operations usually take substantially more time in comparison with overbalanced drilling because some additional procedures are required, such as bleeding off, at least partially, the drill string, and repressurizing it thereafter. Methods and apparatus for continuous circulation are disclosed in the U.S. Pat. No. 3,559,739 to Hutchison and U.S. Pat. No. 6,412,554 to Allen, et al. The system of these patents comprises an upper and lower chambers sealingly encompassing adjacent parts of two drill pipe joints to be connected or disconnected; a gate apparatus for temporarily separating the chambers, ports in the chambers in operational connection with bypassing and bleeding lines. This system is designed to be used with direct circulation of a drilling fluid. It cannot be used reliably with a system evacuating drill cuttings to the surface through the drill string, as it takes place in reverse circulation, because cuttings may damage thread of the box. The least erosion of the threaded end of the drill pipe joint may result in severe complications due to washouts.

Deficiencies of UBD under previous art may be characterized by following:

> " . . . more than 15,000 under balanced wells have been drilled on land in the US and Canada as of September 2002, of which only 9,000 were drilled under balanced over the entire planned length and into completion" (Nina M. Rach, "Underbalanced, near balanced drilling are possible offshore", Oil & Gas Journal, week of Dec. 1, 2003 pp. 39-44).

It means that resources invested in UBD drilling of more than 6,000 wells were substantially lost.

There is a sound need in the industry to overcome above mentioned and some others drawbacks of existing UBD techniques.

3. Objects and Advantages

The first object of this invention is an UBD method for drilling a well bore through and below a permeable formation wherein the well bore is flushed with the formation fluid being produced, whereby loss circulation problem may be eliminated and loss of production due formation damage avoided The second object of the invention is the UBD method wherein a flow rate of the formation fluid being produced while drilling may be kept substantially stable, whereby conditions for a cost effective way for handling a wellhead stream and utilizing produced formation fluids may be created The third object of the invention is the UBD method which may comprise returning any part of produced formation fluid into the well bore being drilled, whereby the problem of disposing the formation fluid may be solved The fourth object of the invention is a cost effective method for adding to or removing from a drill string a drill pipe joint without interrupting the well bore flushing wherewith the drilling method of the invention is supported.

The fifth object of the invention is a lifting gas injector which allows simultaneously pumping in the same channel a lifting gas and produced formation liquid while practicing the UBD method of present invention, whereby the third objective of the invention is supported by apparatus.

Further objects and advantages will become apparent from a consideration of the ensuing description and drawings

SUMMARY OF THE INVENTION

To practice the drilling method of this invention a casing is placed at top of the permeable formation and a rotating blow out preventer (BOP) is mounted on the casing.

Drilling through a permeable formation may start as conventional drilling operation with a drilling fluid which is preferably solids-free. Drilling proceeds until lost circulation/formation fluid influx reaches a value which is indicative of a predetermined formation fluid production rate. Thereafter the well bore is flushed with a formation fluid being produced through the drill string at a controllable rate at least sufficient for drill cuttings transport.

The flow of the formation fluid may be induced either by operating a control valve on a flow line if formation fluid is under sufficient wellhead pressure or by using a gas lift.

A gas lift system may comprise a source of a compressed lifting gas above the ground, at least one lifting gas injector for introducing lifting gas from the casing/drill string annulus into the drill string. The pressure drop through the unique injector of the invention may be set and regulated by altering filtration parameters of the inlet port comprising a plurality of openings with porous inserts. The porous inserts may be of material permeable for a gas but impermeable for liquids such that it is possible to pump into the same channel a lifting gas and a liquid. If an interval to be drilled is long, like for example in horizontal drilling, more than one lifting gas injector of the invention may be included in the drill string and operated from above the ground.

Flow rates of the formation fluid being produced to flush the well bore are regulated by a control valve mounted down stream after the separator.

Produced while drilling formation fluid may be utilized or pumped back into the well bore while drilling.

To make a connection without interrupting well bore flushing, the invention provides a continuous flushing system (CFS) and a method. The CFS comprises a plurality of special three-way adopted for including in the drill string as subs; a bypass line; a pressure release line; a bleed off facility. While making a connection a flow of a flushing fluid is bypassed from a connection point by operating a continuous flushing valve (CFV) and appropriate valves of an above ground system.

The present invention overcomes many deficiencies of previous UBD techniques:

(a) By flushing a well bore with a formation fluid being produced, conditions are created for drilling under balanced through a moderate to highly permeable formations, and loss circulation problem is eliminated.

(b) By pumping produced while drilling fluids, if desired, back into the well bore while drilling the problem of disposing produced fluids may be solved.

(c) By keeping wellhead flow rates substantially stable while drilling and making drill string connections as well as simplifying wellhead flow composition, conditions are created for using separating equipment of less volume and footprint.

(d) By continuing to flush the well bore while making drill string connections the connection time may be dramatically decreased.

BRIEF DESCRIPTION OF THE DRAWINGS

So that the manner in which the above recited features, advantages and objects of the present invention are attained and can be understood in details, a more particular description of the invention, briefly summarized above, may be had by reference to the embodiments thereof which are illustrated in appended drawings.

It is to noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
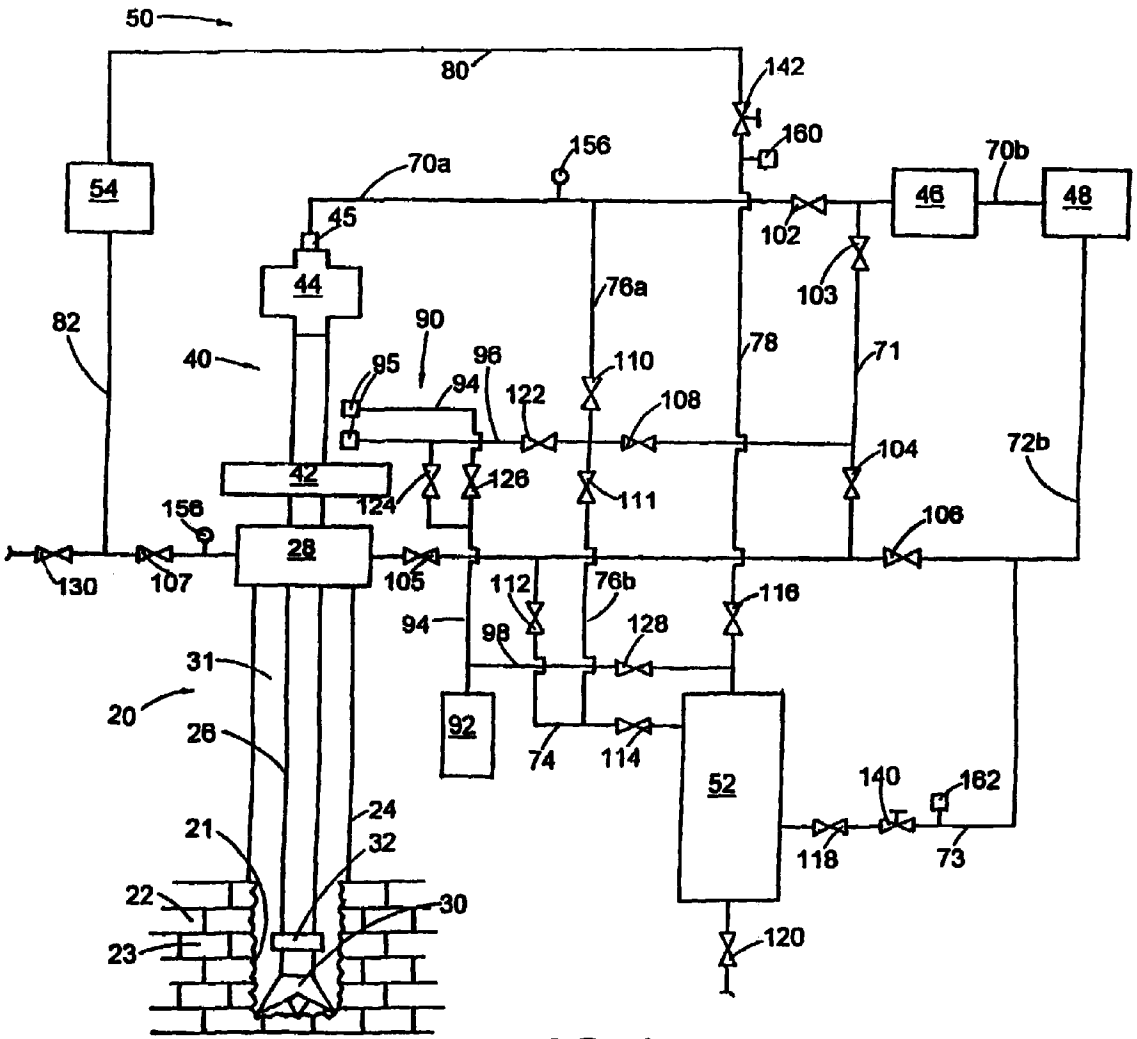
FIG. 1 is a schematic layout of component parts for drilling through a gas formation.

Referring to the FIG. 1, there is depicted a drilling rig 40 and an outlay of component parts of an above the ground system 50 which may be included with the drilling rig to practice the first embodiment of an under balanced drilling method of this invention. A well bore 20 is drilled through the permeable formation 22, and a formation fluid 23 is gas. A casing 24 is placed above formation 22. The well bore has an open hole section 21. A drill string 26 comprises a series of interconnected joints of drill pipe with a through bore. A blow out preventer stack comprises a rotating blowout preventer (RBOP) 28. A drill bit 30 is attached to the drill string. The drill string may comprise a Measurement While Drilling (MWD) device 32 which is capable to provide information comprising the bottom hole pressure.

Drilling rig 40 may comprise a rotary table 42. A top drive 44 may be provided for rotating the drill string. The drilling rig may comprise a mud pump 46 and a drilling fluids handling facility 48.

A separator 52 may be installed for selectively separating a wellhead stream containing at least one fluid and drill cuttings. At least one separator (not shown in FIG. 1) may be mounted in parallel with separator 52.

A compressor 54 may be included in the above surface system.

Figure 2:
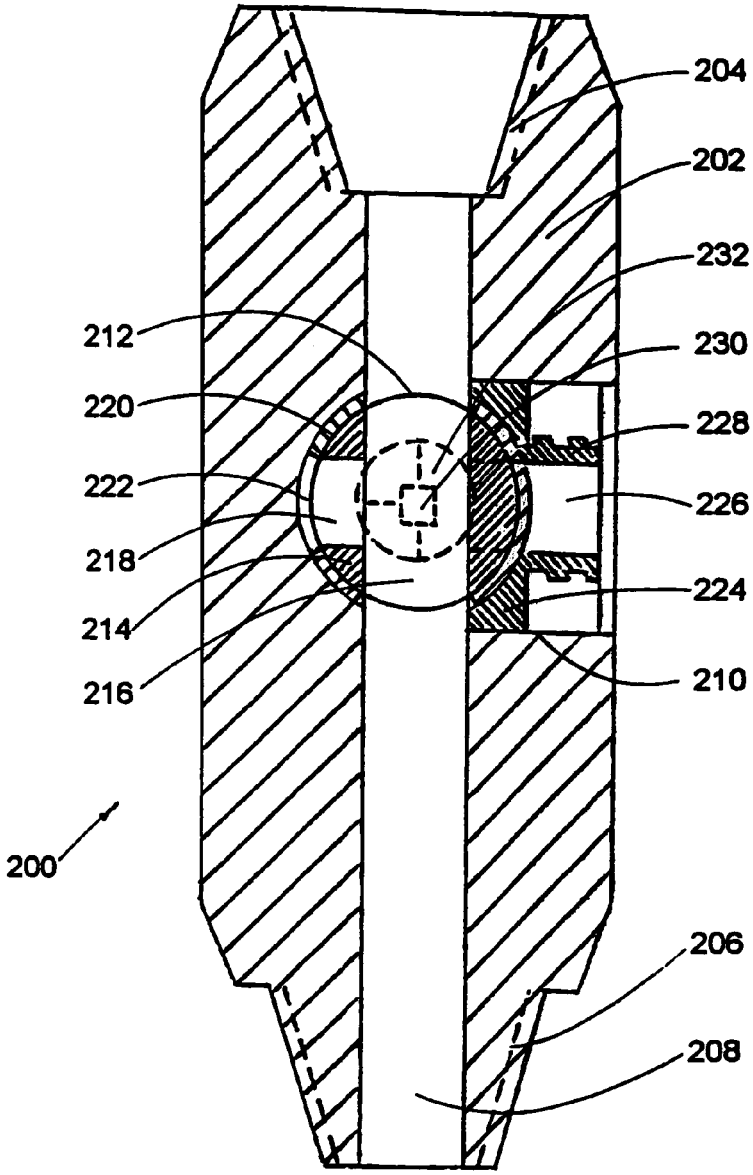
FIG. 2 is a section view of a three-way continuous flushing valve.

A continuous flushing system (CFS) 90 is provided for facilitating well bore flushing while making drill string connections. The preferred CFS comprises a plurality of 3-way valves included in the drill string; a bleed off facility 92; a pressure release line 94 with a connector 95 for temporarily connecting a 3-way valve with the bleed off facility; a bypass line 96 with connector 95 for connecting one of 3-way valves with one of separator 52, bleed off facility 92, mud pump 46. A line 98 may connect bypass line 96 and the bleed off facility. A preferred form of the 3-way valve is shown in FIG. 2 and will be described.

A line 70*a* is provided for connecting the pump 46 with the drill string through a top drive port 45. Physically line 70*a* may be represented by a stand pipe and a drill hose. A line 71 may be provided for selectively routing a fluid from pump 46 into the well bore annulus and to CFS 90. Drilling fluids handling facility 48 may be connected with mud pump 46 by a line 70*b* and with the annulus casing/drill string by lines 72*a* and 72*b*.

Lines 74, 76*a*, 76*b* may be provided to selectively connect separator 52 with annulus line 72*a* and drill string line 70*a*. A line 73 may connect the separator and facility 48 through line 72*b*. Gas lines 78, 80 may be provided to connect separator 52 and compressor 54. A line 82 may be provided for delivering gas from compressor to the annulus casing/drill string and to a commercial gas terminal (not shown)

Valves 102,103,104,105,106,107,108,110,111,112,114,116,118, 120, 122,124,126,130 may be provided for serving as inlet/outlet ports, for opening and closing off a facility, and for changing flow routs of fluids. Preferably at least some of valves have to be of kind designed to be operated directly from a driller's panel (not shown) or through an electronic controller (not shown)

Choke, or control, valves 140 and 142 are provided for regulating back pressure and flow rates.

Manometers 156,158 may be installed to indicate pressure in the drill string and in the annulus of the well bore.

A flow meter 160 may be installed to measure gas flow rates. Additional flow meters (not shown) may be a part of the fluid handling facility 48 and compressor 54.

Drilling through production formation 22 may start with circulating preferably a solids-free drilling fluid.

In reverse circulation operation, pump 46 takes the drilling fluid from facility 48, pumps it through lines 71, 72*a* into the drill string/casing annulus 31 through valve 105 of the RBOP. Open valves are: 103, 104, 105, 110, 111, 114, and 118. Wellhead stream containing the drilling fluid and drill cuttings is directed from port 45 through lines 70*a*, 76 into separator 52. From the separator drilling fluid returns through lines 73, 72*b* to the facility 48. Drill cuttings may be temporarily accumulated inside separator 52.

Drilling is started preferably in overbalanced mode. If the pressure of the head of the drilling fluid is lower than formation pressure, a back pressure in the annulus may be applied by partially closing control valve 140 to create down hole circulation pressure which exceeds formation pressure.

Drilling continues until lost circulation reaches a predetermined value that is indicative for gas production rate sufficient for drill cutting evacuation through the drill string. At this point drilling is temporarily stopped. The mud pump is shut down. By closing valve 118 and by opening valve 116 the rout is created for producing formation gas.

The well is brought to gas production through the drill string by one of techniques known in the art. Produced gas flows through lines 70*a*, 76, into separator 52. From the separator gas is drawn through lines 78, 80 to compressor 54. The compressor may pump produced gas into the well bore through the annulus valve 105 of the RBOP. By operating control valve 142, gas production is established at a rate at least sufficient for drill cutting transport to the surface through the drill string. That rate may be calculated by equations known in art of conventional gas drilling with gas pumped from the surface.

Well bore advancing proceeds with gas as a flushing fluid. Gas 23 from formation 22 flows to drill bit 30, picks drill cuttings up and transports them through the drill string to the surface. After the drilling process is restarted, weight of drill cuttings in the drill string increases the back pressure on the formation that may be indicated by increased readings of manometer 158 or data from MWD 32. The driller operates choke valve 142 to keep gas production rate at predetermined value. The production rate may be measured by flow meter 160. If valve 142 is already full opened, the driller decreases penetration rate to keep production rate at predetermined value.

Drill cuttings entering separator 52 as a part of wellhead stream are being separated from gas and collected therein. After the volume of cuttings in the separator reach a predetermined value, which may be indicated by a sensor (not shown), wellhead stream is directed to separator 52*a* (not shown on FIG. 1) mounted in parallel with separator 52. Valves 114, 116, 118 of the separator 52 are being closed and appropriate valves of the separator 52*a* are being opened. Afterwards the valve 120 is opened, accumulated in the separator solids are discharged, and the separator 52 becomes ready to operate in the next cycle.

Gas from separator may be pumped by compressor 54 into the well bore annulus 31 through valve 107 of RBOP 28.

It will be appreciated that any volume of produced gas may be directed through valve 130 to commercial gas terminal (not shown) for sale. If all produced gas may be sold, and pressure of produced gas is higher then pressure in commercial gas line, there will be no need in compressor 54.

After a drill string joint is drilled down, a new joint is added to the drill string, using Continuous Flushing System (CFS) 90 as it will be explained below after describing a preferred form of a continuous flushing valve (CFV).

As is shown on FIG. 2, CFV 200 comprises a tubular member 202, adopted to be included in the drill string as a sub comprising a threaded box 204 and a pin 206. The tubular member has a central bore 208, a side bore 210, and a hole 212 for mounting a ball 214. The ball has a central bore 216 and a side bore 218. The ball is mounted such that a sectioned ring 220 is placed into a grove 222 of hole 212. The ball is kept in place with a ball retainer 224. The retainer has a through bore 226 and may have a threaded end 228. The threaded end of the retainer constitutes the side port of the CFV such that a conduit may be temporarily attached to it by a coupling. The ball has a hole 230 for placing in a wrench. An indicator 232 may be provided to show a flow pattern through the valve. The CFV may be operated by rotating the ball with a wrench put into the hole 326 through a bore (not shown) in the wall of the sub.

Figure 3C:
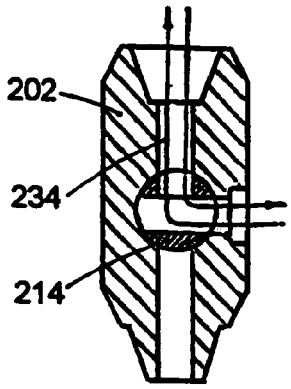
FIG. 3C is a schematic view of the continuous flushing valve in the Down-Side position.
Figure 3B:
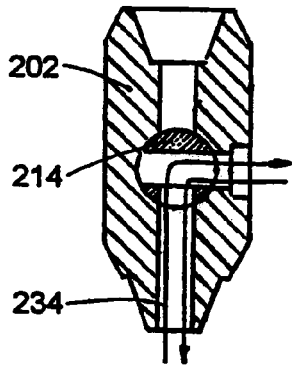
FIG. 3B is a schematic view of the continuous flushing valve in the Up-Side position.
Figure 3A:
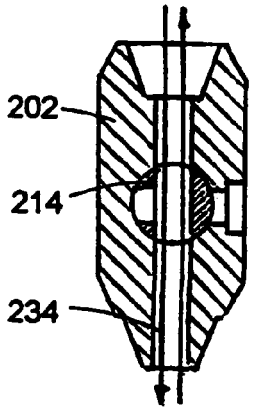
FIG. 3A is a schematic view of the continuous flushing valve in the Through Flow position.

Referring to FIGS. 3A, 3B, 3C, there are shown three positions of ball 310 that make six flow patterns through CFV shown by arrows 330

In the position of the ball shown on the FIG. 3A a fluid may flow in two opposite directions along the axis of the valve. This position may be referred to as Through Flow.

In the position of the ball shown on the FIG. 3B a fluid may flow from and to a conduit below the CFV. This position may be referred to as Up-Side In the position of the ball shown on the FIG. 3C a fluid may flow from and to a conduit above the valve. This position may be referred to as Down-Side.

Figure 4A:
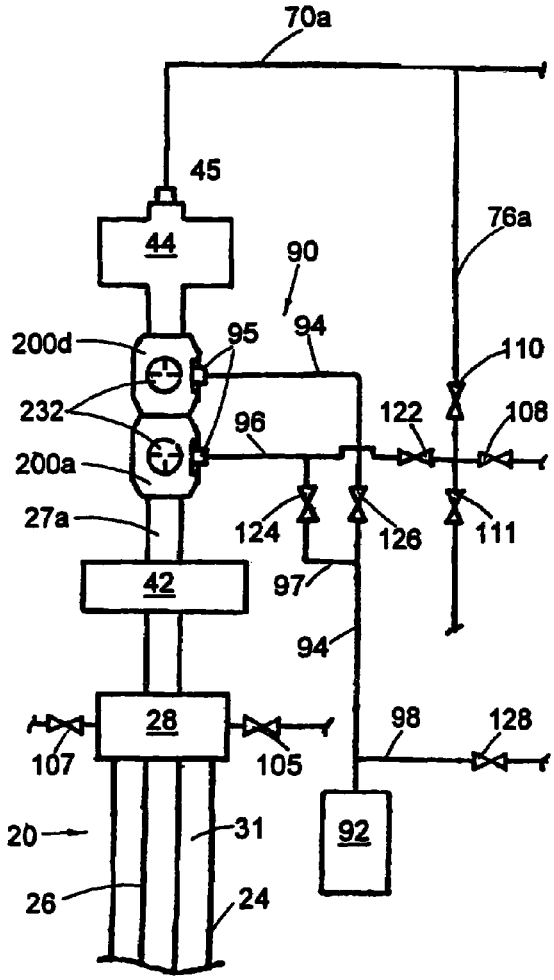
FIG. 4A is a schematic view of a preparatory stage of adding a drill pipe joint.
Figure 4B:
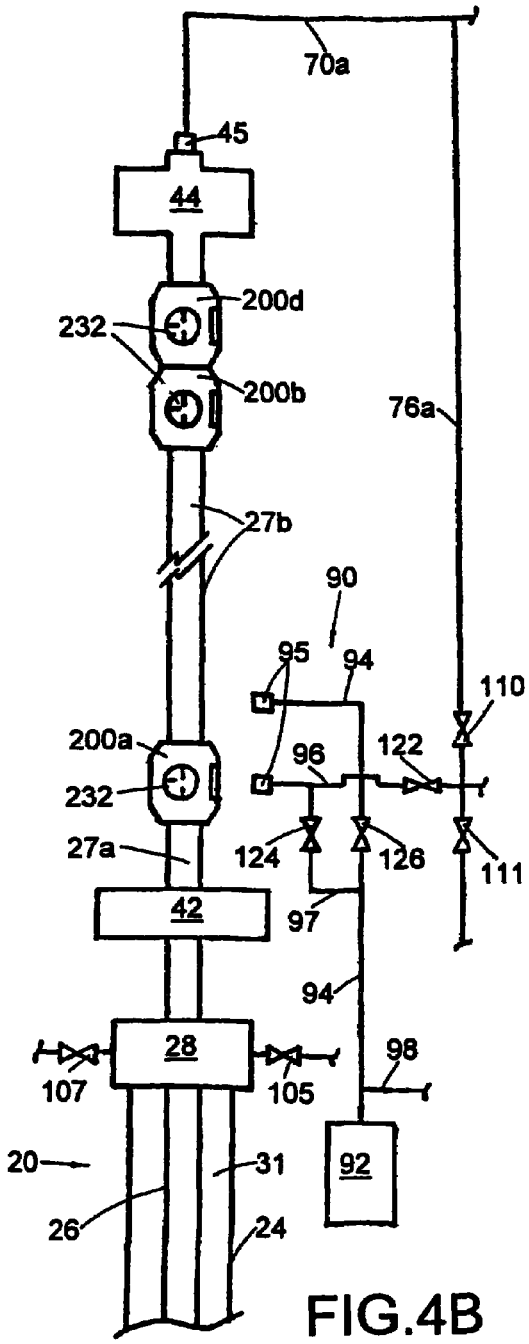
FIG. 4B is a schematic view of a conclusive stage of adding a drill pipe joint.

FIGS. 4A and 4B show in schematic form two stages of making a drill string connection.

FIG. 4A shows some component parts shown in FIG. 1 and described above: a well bore 20 with casing 24, a drill string 26, a rotating BOP 28; a drilling rig 40 with a rotary table 42 comprising a sleeps assembly (not shown); a top drive 44; a continuous flushing system 90 with lines 94, 96 with couplings 95, bleed off facility 92, valves 105,107, 108,110,111, 122, 124, 126. In addition, in FIG. 4A are shown a drilled down drill pipe joint 27*a*, a CFV 300*a* connected to joint 27*a*, and a CFV 300*d* connected to top drive 44. In FIG. 4B, in addition to components shown in FIG. 4A, a joint 27*b* with a CFV 300*b* is depicted.

Drill string make up, while flushing the well bore with produced gas or with a drilling fluid pumped from above the ground in reverse circulation mode, may be made in following steps:

1. Set the drill string in slips (not shown) after joint 27*a* is drilled down such that CFV 300*a* is positioned above rotary table 42. The well head stream containing and drill cuttings flows through lines 70*a*, 76 into separator 52 (see FIG. 1);
2. Connect pressure release line 94 by coupling 95 to CFV 300*d*, and bypass line 96 by coupling 95 to CFV 300*a* as it is shown on FIG. 4A;
3. Open valve 122 on line 96, set CFV 300*a* to Up-Side position as shown by indicator 328*a*, afterwards close valve 110 such that the well head stream is bypassed through line 76*b* into separator 52;
4. Set CFV 300*d* to Down-Side position shown by indicator 328*d*. Open valve 126 releasing content of conduits above CFV 300*d* into bleed off facility 92. Close valve 126 and disconnect bleeding off line 94 is from CFV 300*d*
5. Disconnect top drive 44 with CFV 300*d* from the drill string and, as it is shown in FIG. 4B, made it up to CFV 300*b* of joint 27*b*. Connect joint 27*b* to the drill string through CFV 300*a*. Valves 300*d* and 300*b* are in Through Flow position as shown by indicators;
6. Open valve 110, set CFV 300*a* in Through Flow position, close valve 122 on line 96 such that the wellhead stream flows through the top drive and lines 76*a*, 76*b* into separator 52.
7. Depressurize bypass line 96 into bleed off facility 92 by opening valve 124, disconnect it from CFV 300*a;*
8. Resume drilling If it is desired to start drilling through production formation with direct circulation of the drilling fluid, some changes in above described procedure will be made by those skilled in the art.

Tripping the drill string from the well bore 20 being drilled as it was described above with reference to FIG. 1 and filled with gas under formation pressure as well as completing the well may be done by using CFS 90 and one of techniques of under balanced drilling disclosed in U.S. Pat. No. 6,167,974 to Webb, and U.S. Pat. No. 6,209,663 to Hosie. These techniques comprise mounting a valve as a part of casing, preferably adjacent production formation. These valves known as "Well Control Valve", "Downhole Deployment Valve" may be opened and closed by a drill bit movement. The valves are available from Halliburton and Weatherford corporations.

Figure 5:
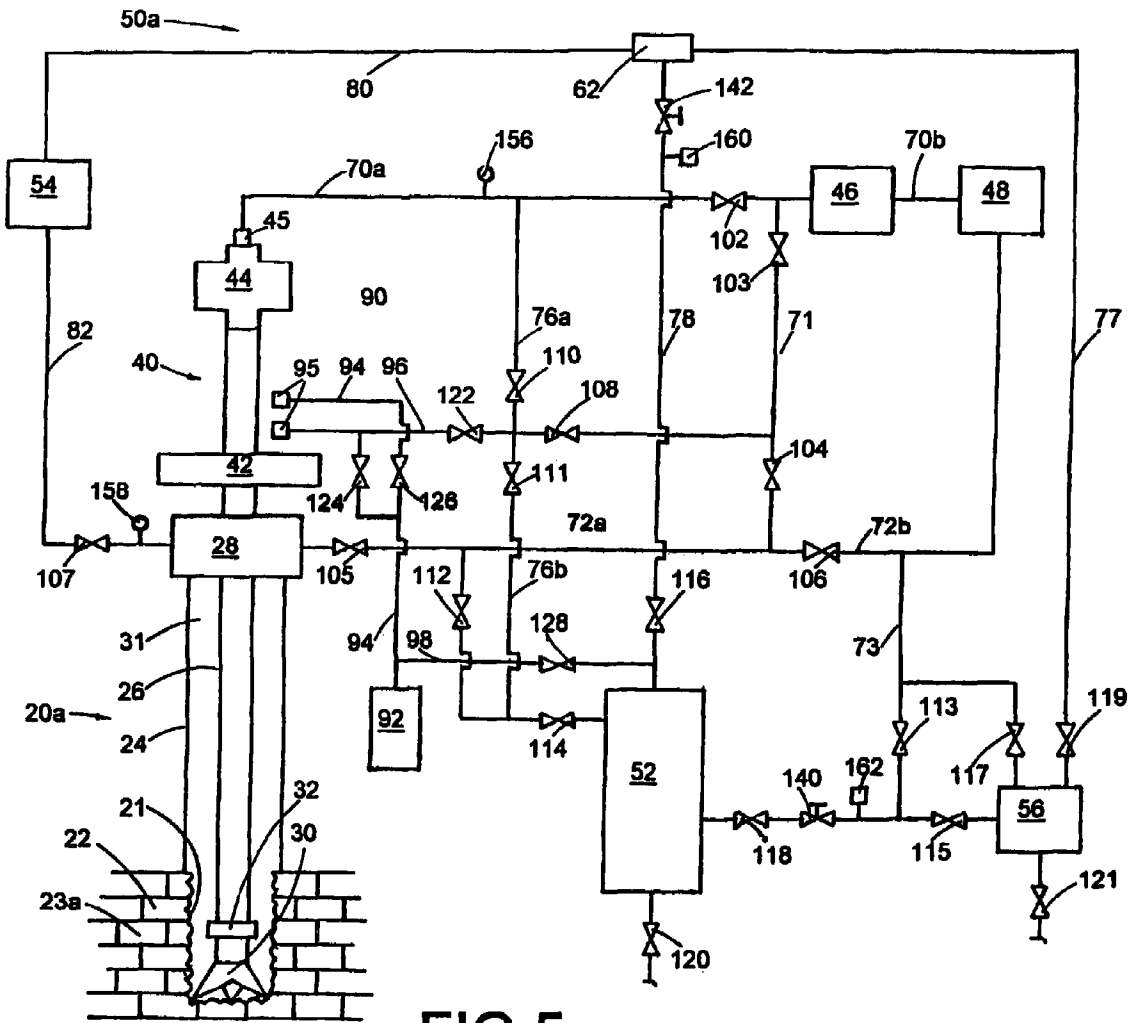
FIG. 5 is a schematic layout of component parts for drilling through an oil formation capable to produce oil without assistance.

Referring to the FIG. 5, there is depicted an outlay of component parts for drilling through formation 22 capable to produce oil 23*a* without assistance at a rate sufficient for drill cuttings evacuation through the drill string. Hydrocarbon gas may be dissolved in oil.

Component parts of well bore 20, drilling rig 40 and a continuous flushing system 90 are identical to those described above with reference to FIGS. 1, 2.

Component parts of an above ground system 50*a*, in addition to those of system 50 described above with reference to FIG. 1, may comprise a produced oil handling facility 56, a jet pump 62, mounted in separator 52, additional piping and valves. A line 75 connects oil handling facility 56 through line 73 with drilling fluids handling facility 48. A line 77 delivers produced gas from facility 56 to gas line 80 through jet pump 62.

Facility 56 may comprise a low pressure separator, tanks, pumps, flow meters.

Jet pump is of kind known in the art and provides for combining two gas flows of different pressures.

Drilling through formation 22 starts with preferably solids-free drilling fluid, such as a hydrocarbon liquid, with direct or, preferably, reverse circulation. In reverse circulation operation, pump 46 takes the drilling fluid from the facility 48 and pumps it through line 71 (valve 102 is closed) and line 72*a* into annulus 31. Wellhead stream containing drilling fluid and drill cuttings flows from port 45 of top drive 44 through lines 70*a*, 76*b* into separator 52. Drill cutting are accumulated inside the separator. Drilling fluid from the separator flows through lines 73, 72*b* to drilling fluid handling facility 48.

As soon as well bore reaches the first oil zone, oil starts to flow to the surface with drilling fluid. Down hole pressure increases up to formation pressure. Drilling fluid is getting lost into formation. Formation oil fraction in wellhead returns is increasing up to 100%. From this point mud pump 46 may be shut down. Control valve 140 is operated to establish and keep oil production at predetermined rate sufficient for drill cuttings evacuation through the drill string. Wellhead stream comprising oil, gas and drill cuttings enters separator 52. Drill cuttings and some gas are selectively separated from oil. Cuttings are accumulated in the separator. Gas may be released through valve 116 into line 78. Oil with remaining gas is drawn to produced oil handling facility 56

Gas separated from the oil in the facility 66 may be directed through line 77 to jet pump 62 therein it is mixed with gas from separator 52 and directed to compressor 54.

Produced oil from the facility 56 may be sent in any proportion to facility 48 for pumping back into well bore annulus 31 through valve 103 and/or to a commercial oil terminal (not shown), through valve 121.

After a volume of drill cuttings in separator 52 reaches a predetermined value the wellhead stream is directed to separator 52*a* (not shown), as it was described above in the first embodiment of the drilling method. Solids accumulated in separator 52 are discharged through valve 120, and separator 52 is ready to operate in the next cycle.

The process of making drill string connections using the continuous flushing system 90 has been described above with reference to FIGS. 4A, 4B.

Tripping the drill string from the well bore filled with oil under wellhead pressure, as well as completing the well, may be done by using CFS 90 and one of techniques known in under balanced drilling of previous art, such as using a downhole deployment valve.

Figure 6:
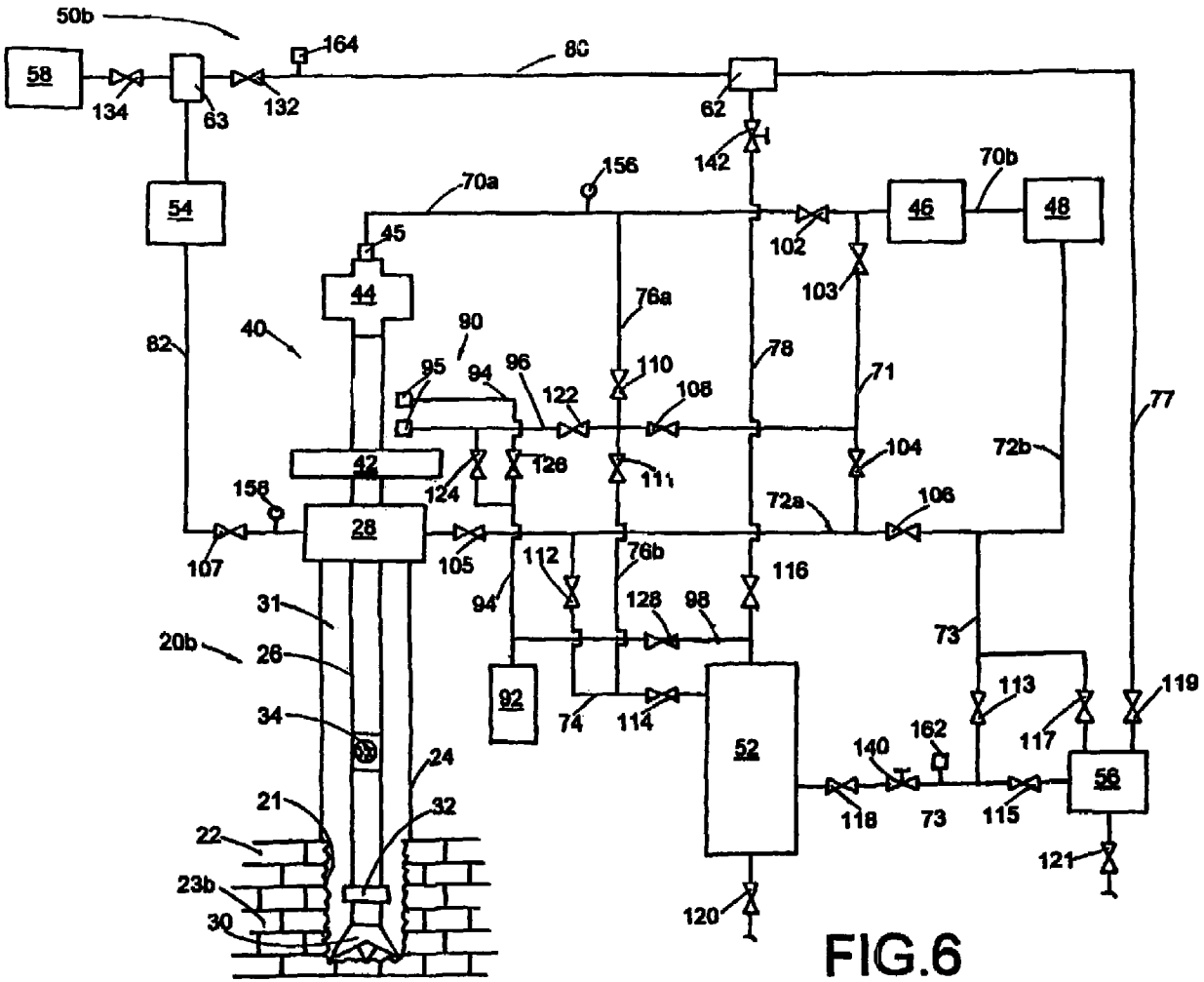
FIG. 6 is a schematic layout of component parts for drilling through oil formation with gas lift.

Referring to the FIG. 6, there is depicted an outlay of component parts which may be used to drill a well bore 20*a* through a formation 22 bearing oil 23*a*. Hydrocarbon gas may be dissolved in oil. The formation pressure is lower than pressure exerted on the formation by a drilling fluid. The formation is capable to produce oil with gas lift at a rate sufficient for drill cuttings evacuation through the drill string.

The component parts of a drilling rig 40 and continuous flushing system 90 are identical to those have been described above with reference to FIGS. 1, 2.

The component parts of an above surface system 50*a*, in addition to those depicted in FIG. 5 and described above, may comprise a source of lifting gas 58, a jet pump 63, additional piping and valves.

The source of lifting gas may comprise a membrane unit 58 for producing nitrogen from air. Unit 58 is of kind being used in existing under balanced drilling techniques. It may be connected with the compressor 54 through jet pump 63.

Component parts of well bore 20*a*, in addition to those depicted in FIG. 5, may comprise a lifting gas injector 34, included in the drill string.

Lifting gas is delivered to the injector through drill string/casing annulus 31 sealed with rotating blowout preventer (RBOP) 28.

An initial position of lifting gas injector 34 in the well bore as well as lifting gas injection rate are defined according methods known to those skilled in the gas lift technology.

If an interval to be drilled is long, like for example in horizontal drilling, injector 34 can exit the optimal interval for gas lift operation or even exit the casing. To avoid partial drill string trips for placing the injector in optimal interval, more than one LGI, operable from the surface, which will be described later with reference to FIG. 11, may be used. When the first LGI leaves the optimal interval, the second one reaches it. At this time the second injector is set in "open" position by coded signals sent by the transmitter, and so on.

Drilling through formation 22*a* may start as a conventional overbalanced drilling operation preferably with a solids-free drilling fluid such as a hydrocarbon liquid. The drilling fluid may be circulated in reverse or direct mode. In direct circulation, mud pump 46 takes drilling fluid from facility 48 and pumps it into the drill string through port 45 of top drive 44. The wellhead stream containing drill cuttings may return to drilling fluid handling facility 48 through lines 72*a*, 72*b*. Open valves are: 102, 103,106.

As soon as the well bore enters a permeable zone of the formation, the drilling fluid is getting lost into formation at some rate as the formation pressure is lower then circulating fluid pressure and no filter cake is formed on formation in an open hole 21 by the solids free drilling fluid. Drilling continues until lost circulation reaches a predetermined rate which indicates that oil may be produced at rate sufficient for drill cuttings transport through the drill string. The well bore is flushed clear if there are still enough circulation returns. If circulation had been lost completely, the drill pump is shut down. If lifting gas injector 34 was not included in the drill string, it has to be included.

Valve 102 on line 70*a* and valve 106 on line 72 are closed. Sealing element of the RBOP is engaged. Compressor 54 starts to pump nitrogen from nitrogen source 58 through annulus access valve 107 of RBOP 28 into annulus 31. After the gas pressure in the annulus sensed by manometer 158 reaches a predetermined value, valves 110,111 on line 76*a*, and valves 114, 116, 118 of separator 52 are opened. Nitrogen enters the drill string through injector 34, and oil production begins. By operating control valve 140 oil production is being established at rate at least sufficient for drill cuttings evacuation through the drill string. At the same time control valve 142 on gas line 78 is operated to keep the oil/gas interface in separator 52 at a predetermined level monitored by a sensor (not shown).

As produced oil may be not completely separated from gases in separator 52, oil with remaining gas, if desired, may be drawn from separator 52 to oil handling facility 56 which may comprise a low pressure separator.

Gas separated from the oil in facility 56 may be directed through line 77 to jet pump 62 therein it is mixed with gas from separator 52. Gas from jet pump 62 is metered and flows to jet pump 63. In the jet pump 63 a mix of nitrogen and hydrocarbon gases from the jet pump 62 is combined with the nitrogen from unit 58 such that the rate of lifting gas delivered to compressor 54 remains constant. It will be appreciated by those skilled in the art that by utilizing separated gas in this way, the amount of lifting gas from nitrogen unit may be decreased as well as associated expenses of operating the nitrogen unit.

Produced oil may be pumped into the well bore annulus 31 as the unique design of the lifting gas injector of the present invention, which will be described later, makes it possible to pump into the same channel a fluid and lifting gas. If desired, produced may be sent through valve 121 to a commercial oil terminal (not shown) for sale.

As soon as by operating control valve 140 oil production is established at rate at least sufficient for drill cuttings evacuation through the drill string, the drilling process resumes. Oil 23*a* flows from formation 22 to drill bit 30, picks drill cuttings up and transports them to the surface. Drill cuttings' weight increases back pressure on the formation, but in the same time new production zones may be opened, so the driller operates choke valve 140 to keep oil production rate at predetermined value. If the check valve gets full open, the driller chooses a rate of penetration that allows keeping oil production rate at predetermined value.

The wellhead stream entering separator 52 comprises produced oil, hydrocarbon gas, nitrogen gas, and drill cuttings. In the separator drill cuttings are separated from fluids. The process of handling wellhead stream fluids has been described above with reference to FIG. 5

Drill string connections may be done using continuous flushing system 90 as it has been described above with reference to FIGS. 4A, 4B such that oil production rate through the drill string remains substantially steady.

Since formation in this embodiment can not produce oil without assistance and there is no wellhead pressure when oil is not produced with the gas lift, tripping the drill string and completing the well bore may be done using procedures known in the art.

Figure 7:
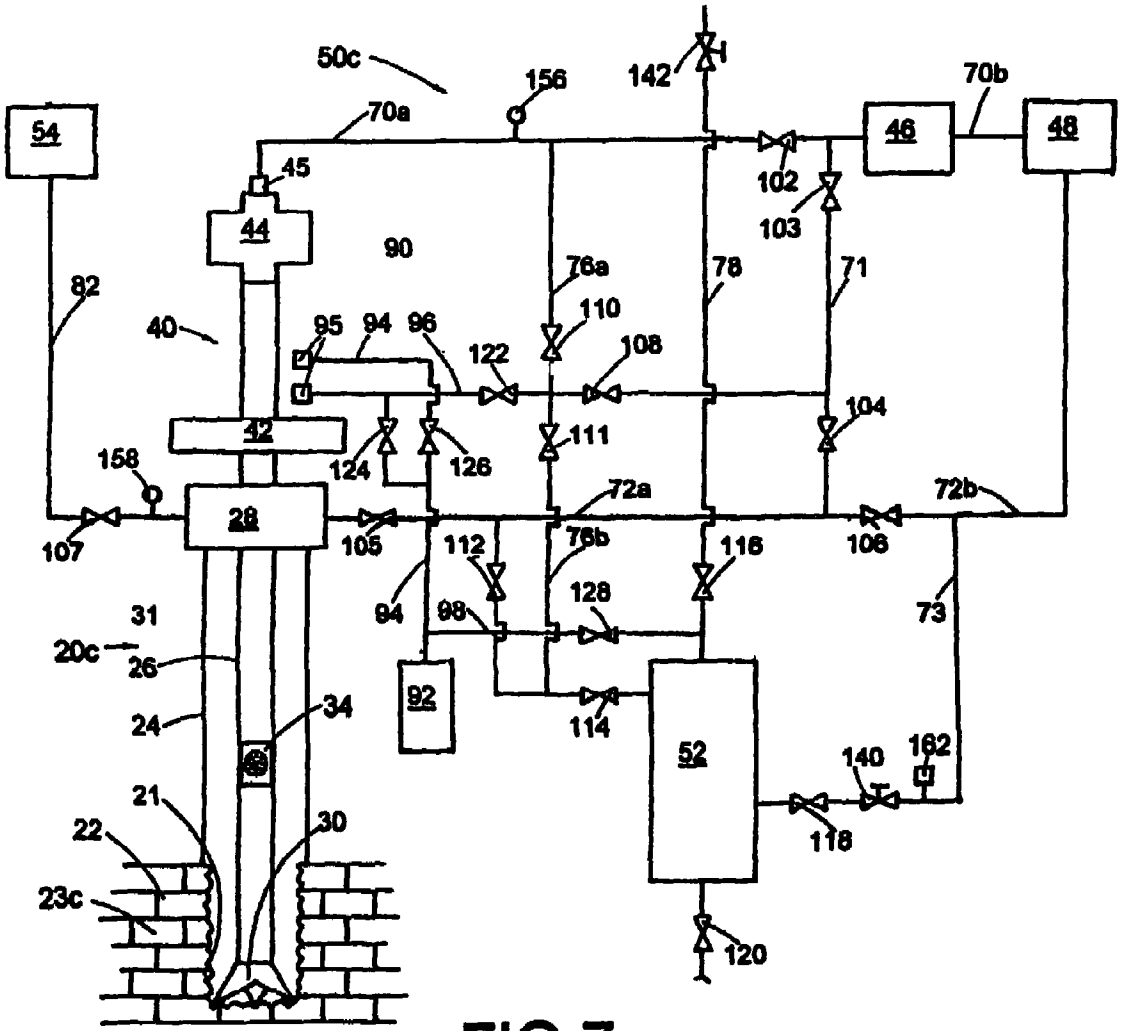
FIG. 7 is a schematic layout of component parts for drilling through water formation with air lift.

Referring to the FIG. 7, there are depicted a drilling rig 40 and an outlay of components of an above ground system 50*c* that may be provided for drilling a well bore 20*c* through formation 22 bearing water 23*c*. The formation pressure is lower than pressure exerted on the formation by circulated drilling fluid. The formation is capable to produce water with air lift at a rate sufficient for drill cuttings evacuation through the drill string.

Component parts of drilling rig 40 and a well bore 20*c* are identical to those depicted on FIG. 6 and described above.

Component parts of above surface system 50*c* are nearly the same as of the system depicted on FIG. 1 and described above.

The underlying principles of air lift operation in this embodiment of the drilling method are the same as in gas lift oil drilling described above with reference to FIG. 6.

Drilling an open section 21 of the well bore 20*c* starts with a drilling fluid circulated by mud pump 46. In direct circulation, mud pump 46 takes drilling fluid from facility 48 and pumps it into the drill string through port 45 of top drive 44. The wellhead stream containing drill cuttings may return to drilling fluid handling facility 48 through lines 72*a*, 72*b*. Drilling proceeds until lost circulation reaches a rate that makes further drilling ineffective, impossible, or undesirable If gas lift injector 34 was not included in the drill string, it gets included. The above surface system 50*c* is configured for flushing the well bore with formation water produced through the drill string with air lift. Valve 102 is closed as well as valve 104. Valves, 114, 116, 118 of separator 52, as well as valves 110,111 and control valves 140 and 142 are opened. RBOP 28 is engaged.

Compressor 54 pumps air into the well bore annulus 31 through annulus valve 107 of the RBOP. After air pressure in the annulus reaches a predetermined value, valve 110 on line 76*a* is opened. Compressed air flows through injector 34 into the drill string 26, and water production starts. Produced water may flow through lines 76*a*, 76*b* into the separator 52.

By operating choke valve 140 water productions is established at a rate sufficient for drill cuttings transport through the drill string. Drilling the well bore resumes. Formation water 23*c* flows to drill bit 30, picks drill cuttings up and transports them upward through the bore of the drill string. Wellhead stream flows through lines 70*a* and 76*a*, 76*b* into separator 52. Drill cuttings being separated from fluids and accumulated in the separator. Air from the separator is vented through control valve 142.

Produced water exits the separator through valve 118 and through lines 73 and 72*b* is drawn to drilling fluids handling facility 48. The driller operates choke valve 140 and keeps the flow rate of formation water, measured by flow meter 162 at substantially stable rate. If the choke valve gets full open, the driller chooses a rate of penetration that allows to keep water production rate at predetermined value. Readings of manometer 158, which are indicative for bottom hole pressure, together with readings of manometer 156 help the driller to choose appropriate rate of penetration which will not overload the flow inside the drill string with cuttings. For example, if the readings of manometer 158 begin to increase, and readings of manometer 156 begin to decrease, while rate of penetration remains unchanged, it is a signal of overloading.

After solids in the separator reach predetermined level indicated by a sensor (not shown), the wellhead stream, as it was described above, is routed to a separator (not shown) mounted in parallel with separator 52. Drill cuttings are discharged through valve 120, and separator 52 is ready to operate in the next cycle.

The unique design of the inlet port of lifting gas injector of present invention, which will be described below, makes it possible to pump into the same channel water and compressed air. Mud pump 46 may take produced water from facility 48 and through lines 71, 72 and pump it into annulus 31 through valve 105.

Since produced water disposal in under balanced drilling under previous art easily becomes costly or even prohibitive problem, the solution of this problem by the present invention will be appreciated by those skilled in the art and interested in drilling through lost circulation zones and water wells.

The process of making drill string connections using the continuous flushing system 90 may be the same as it was described above with reference to FIGS. 4A, 4B.

Tripping the drill string after air is released from annulus 31 may be done using procedures known in the art.

To achieve some of its objects, as it was mentioned above, the drilling method of present inventions utilizes a special adjustable lifting gas injector (LGI).

Figure 8:
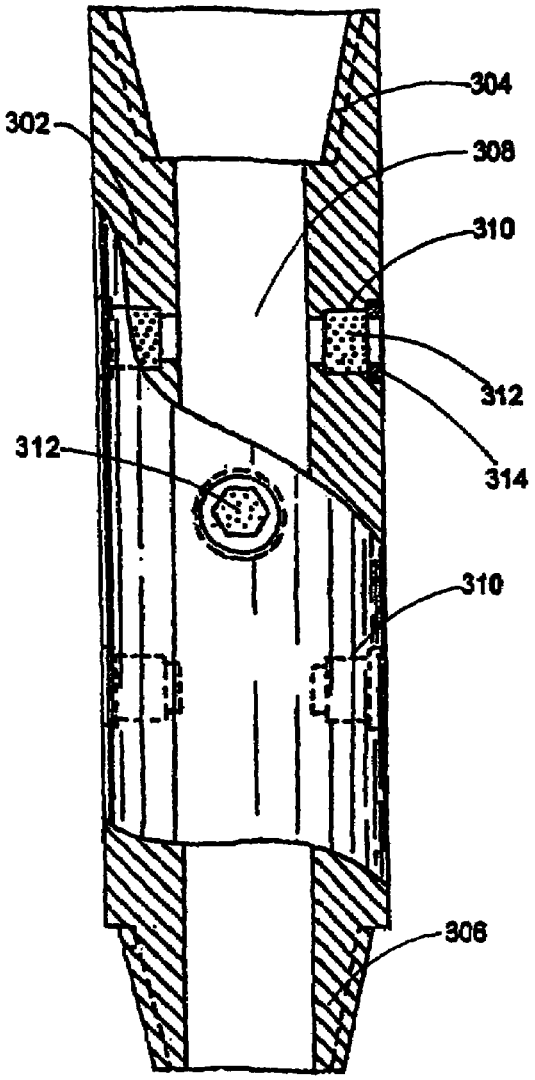
FIG. 8 is a partly sectional illustration of the first embodiment of the lifting gas injector (LGI).

FIG. 8 shows the first embodiment of the LGI comprising a tubular member 302 adopted for including it in a drill string as a sub with a threaded box 304 and a pin 306. The tubular member comprises a central passage way 308 and at least one of a plurality of openings 310. Each opening is adopted for mounting a porous insert 312 made of a permeable material or a plug of the same shape (not shown). Inserts and plugs may be kept in place by a threaded retainer 314. Openings 310 with inserts and plugs constitute an inlet port of LGI.

It is known to those skilled in the art of reservoir mechanic that if gas flows through a porous media with a given permeability and the porous media is approximately 100% saturated with gas, the media permeability for a liquid may be practically zero. When a lifting gas flows through the inlet port of the LGI the porous inserts are 100% saturated with gas. Thus the porous inserts make possible simultaneously pumping into the drill string/casing annulus lifting gas and a liquid, for example produced oil or water. It will be appreciated that by disposing produced liquids back into production formation while drilling, one of the disadvantages of under balanced techniques under previous art may be addressed.

The design of the inlet port of injector is based on Darcy's law. In accordance with this law, if a fluid flows through a sample of a porous media, pressure drop through the sample depends on flow rate, on viscosity of fluid, on filtration parameters of the sample. These parameters comprise permeability coefficient of porous media, cross section area and length of the sample.

While designing the inlet port of the LGI, it is kept in mind that while drilling the LGI is moving inside the casing from predetermined uppermost and lowermost positions.

The process of designing an inlet port of the LGI for identified well bore conditions may start with determining an injection rate of the lifting gas, and hydrostatic pressure at the selected lowermost position of the injector in the well bore. Thereafter, feasible area of filtration and length of the insert may be chosen. For given injection rate, hydrostatic pressure, filtration area and length of the insert, and permeability coefficient equal 1 Darcy, the injection pressure and pressure drop through one insert is calculated. The calculation is made using known in the art Darcy's equation. The value of obtained pressure drop is divided by a feasible number of openings 310 of the inlet port. If resulted value is not sufficiently close to the predetermined pressure drop, calculations are repeated with altered insert's permeability coefficient, filtration area and length. The calculations continue until obtained value of pressure drop is lower but sufficiently close to the predetermined one. The pressure drop predetermined in the drilling program may be set by plugging off some openings 310 with plugs.

It is understandable that the more openings has the inlet port and the lower is permeability coefficient, the more precisely the pressure drop through the inlet port of the LGI may be set.

In operation, lifting gas flows from the casing/drill string annulus through inserts 312 of the inlet port of the LGI into central passage way 302 where it mixes with the formation liquid. The pressure drop through the inlet inserts keeps the liquid/gas interface below the injector.

Those skilled in the art will also appreciate that lifting gas, flowing into the central bore through porous inserts, is discharged in small babbles that is known to improve gas lift efficiency.

The LGI of the first embodiment shown in FIG. 8 may be used preferably with the drilling method of the invention when a permeable formation, for example a lost circulation zone, is already encountered while drilling with a conventional technology.

Figure 9:
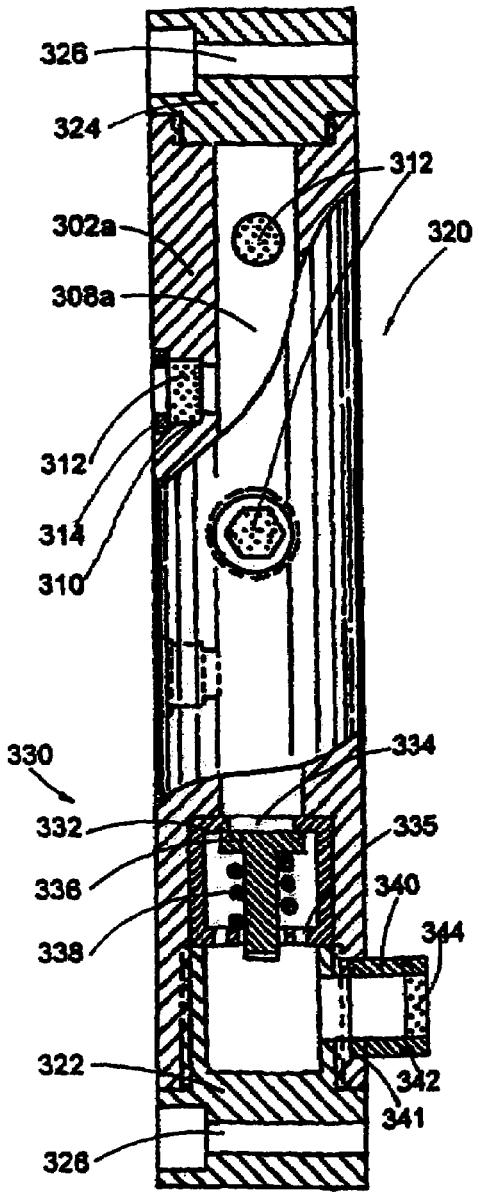
FIG. 9 is of a partly sectional illustration of a flow regulator of the second embodiment of the LGI.
Figure 10:
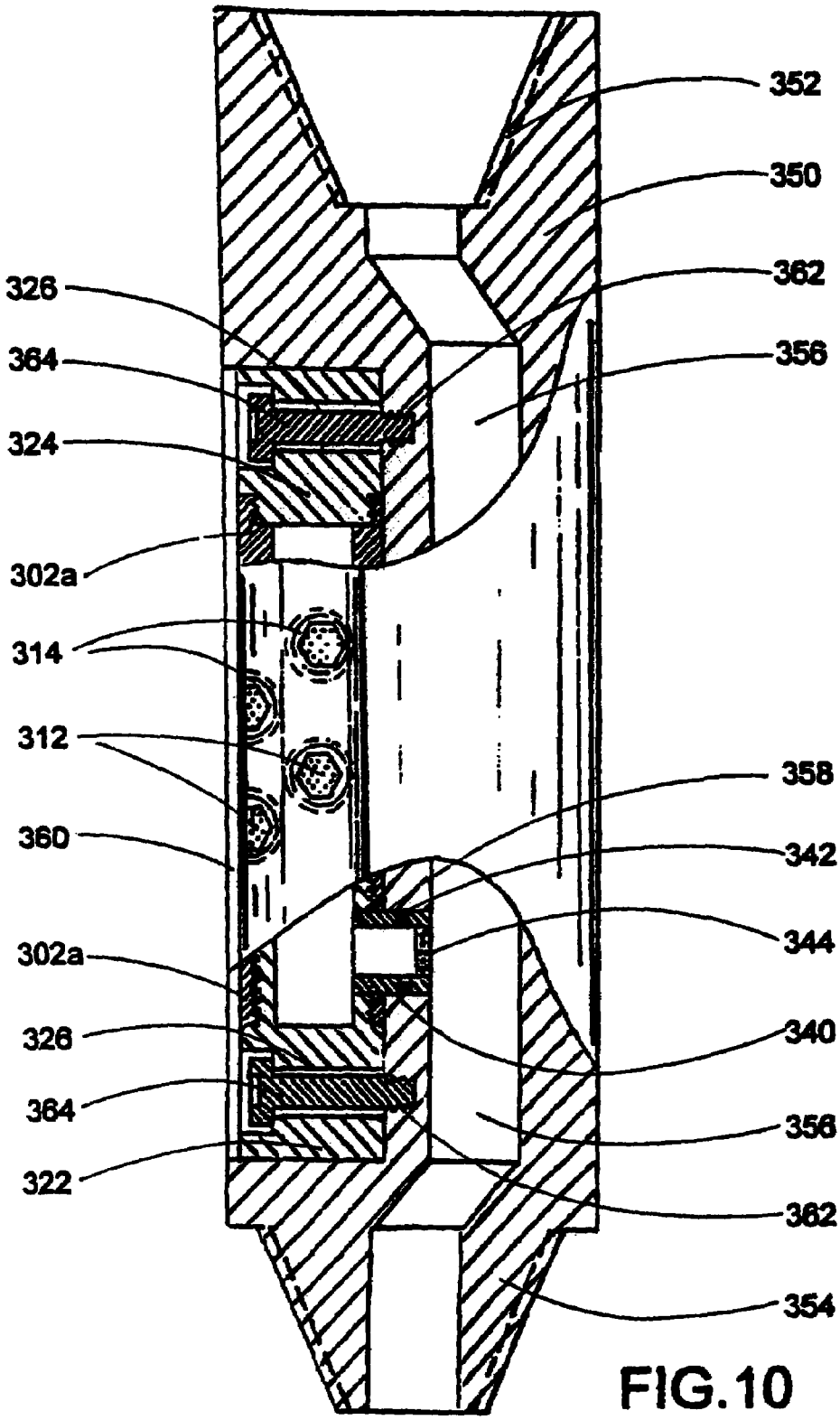
FIG. 10 is a partly sectional illustration of a side pocket sub with a flow regulator of the LGI.

FIGS. 9 and 10 show the second embodiment of the of the adjustable lifting gas injector (LGI). In this embodiment LGI comprises a flow regulator 320 and a side pocket sub 350.

Referring to the FIG. 9, flow regulator 320 comprises a tubular member 302*a* with at least one of a plurality of openings 310. The openings are adopted to include a porous insert 312 or a plug of the same shape (not shown). Inserts and plugs may be kept in place by a threaded retainer 314. Openings 310 with porous inserts and plugs constitute an inlet port of LGI. A check valve 330 is mounted inside the tubular member and is kept in place with a threaded lower plug 322. Lower plug 322 and an upper plug 324 seal the tubular member which is thereafter referred to as a housing 302*a* of the flow regulator. Each plug may comprise a bore 326 for placing a bolt (not shown in FIG. 8).

A connecting pipe 340 is mounted into a side opening 341 of housing 302*a* below the check valve.

A check valve 330 may comprise a housing 332 with an inlet opening 334 and a plurality of outlet openings 335, a valve 336, and a spring 338. Check valve makes it possible to drill with direct circulation of a drilling fluid and may be included in the drill string in advance. As a result the well bore may be ready for formation fluid production with gas lift in the drilling method of this invention without partial drill string trip for mounting the injector.

A connecting pipe 340 with an O-ring 342 may include discharger 344. The discharger may be made of porous material to break a gas flow in small babbles for improving gas lift efficiency. In addition, the discharger may protect the check valve from being contaminated with any particulate material, which may be present in fluids inside the drill string and which may break functioning of the check valve.

The design of the inlet port of the flow regulator is based on Darcy's law and have been described above.

Flow regulator 320 is adopted for including into a drill string by mounting it into side pocket sub 350. FIG. 10 shows flow regulator 320 mounted in side pocket sub 350. Side pocket sub 350 has threaded box 352 and pin 354 for including it in a drill string. A central passageway 356 of the sub may be placed asymmetrically to provide more space for a side pocket 360. A bore 362 connects the side pocket with passageway 356.

Regulator 320 is mounted in side pocket 360 such that connection pipe 340 with O-ring 342 is placed into side opening 362 of the sub. The regulator may be fastened to the sub with bolts 366 put into bores 326 of plugs 322, 324 and bolted in holes 364 in the wall of the side pocket.

In operation, lifting gas enters porous inserts, flows through the check valve and discharges into the central passageway of side pocket sub through discharger 344 of connecting pipe 340.

Figure 11:
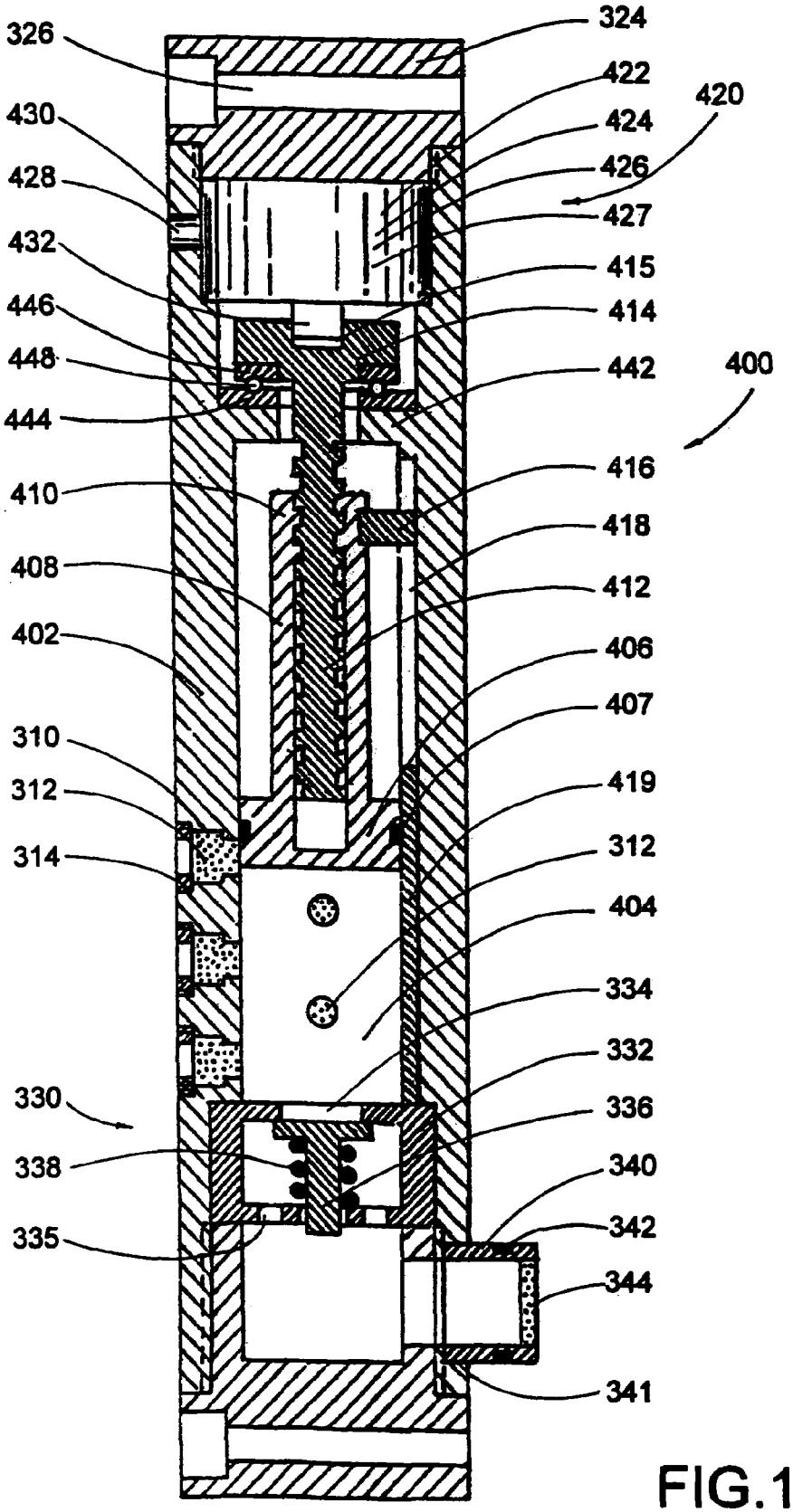
FIG. 11 is a sectional illustration of a remotely controlled flow regulator of the LGI.

FIG. 11 depicts a remotely controlled flow regulator 400 which is adopted to be mounted in the side pocket of the sub as it has been described above for flow regulator 320 with reference to FIG. 10. Flow regulator 400 together with the side pocket sub described above constitutes the third embodiment of the lifting gas injector of the invention.

Remotely controlled flow regulator 400 comprises a housing 402, a check valve 330, a connecting pipe 340, plugs 322, 324, a piston 406, a power unit 410, a bearing 412.

The housing may comprise a plurality of side openings 310. The openings are adopted to include a porous insert 312. Inserts may be kept in place by a threaded retainer 314. Side openings with porous inserts constitute the inlet port of the flow regulator. The way of choosing the number and area of side openings as well as choosing permeability coefficient of inserts is the same as it was disclosed above with reference to FIG. 8

A check valve 330 may comprise a housing 332 with an inlet opening 334 and a plurality of outlet openings 335, a valve 336, and a spring 338. The check valve is kept in place with a threaded lower plug 322.

A connecting pipe 340 is mounted into a side opening 341 and may include a discharger 344.

An upper plug 324 and a lower plug 322 may comprise an opening 326 for placing a bolt.

Piston 406 has an O-ring 407. A sleeve 414 with a nut 415 is affixed to the piston. A flat member 416 is affixed to nut 415 and is movable along a slot 418 thus preventing rotation of the piston. The screw, nut, and flat member constitute a leading screw and nut assembly. A screw head 409 has a hole 411, for example, of square shape. A plugging member 419 may be placed into slot 418 after the piston is placed into the housing.

The piston divides a flow chamber 404 substantially tight in two parts such that lifting gas may flow only through the part located below the piston. By moving the piston along the flow chamber an active filtration area of the inlet port may be changed. In this way pressure drop through the injector may be regulated. In the lowermost position the piston covers an inlet opening 334 of the check valve and closes the LGI.

Power unit 420 comprises an electric motor 422, a battery 424, an electronic controller 426 with a microprocessor 427, a signal receiver, preferably a microphone, 428 in an opening 430.

A motor's shaft 432 is adopted to be in operative connection with screw 408 through a hole 410 in screw head 409.

A supporting bearing 440 may be provided to avoid potential damage to the motor by a downward force resulted from difference in gas pressure below and above the piston. The bearing is placed on a shelf 442 of the housing 402. The bearing comprises a lower ring 444, an upper ring 446, and balls 448. The screw head is adopted to be set immovably into the upper ring.

To control the LGI, coded signals may be sent by using, for example, a system disclosed in U.S. Pat. No. 6,384,738 to Carstensen, et. el. The system of the patent . . . 738 utilizes a portable computer and an air gun for propagating brief coded pressure impulses through fluid media. These impulses may be detected by a microphone.

Depending on drilling program, ALGI with remotely controlled flow regulator may be included in the drill string either in open or closed position. To open the regulator or to adjust lifting gas injection pressure the operator actuates the transmitter located above the ground. Microphone 428 detects pressure impulses generated by the air gun of the transmitter. Microprocessor 427 of the controller 426 compares these impulses with patterns stored in his memory and actuates motor 422, which, by rotating screw 408, moves the piston thereby active filtration area is being changed until lifting gas injection pressure reaches a predetermined value.

In gas lift operation, lifting gas flows through porous inserts located below piston 406, through check valve 330, and discharges into the central passageway 356 of the side pocket sub (see FIG. 10).

From the description above, a number of advantages of my under balanced drilling method and apparatus become evident:

(a) Conditions are created for drilling under balanced through a moderate to highly permeable formations as loss circulation problem is eliminated by flushing a well bore with a formation fluid being produced while drilling (b) The costly and even prohibitive problem of disposing formation fluids produced while drilling is to a large extent alleviated. If desired, they may be pumped back into the well bore while drilling and making drill string connections. The unique design of the lifting gas injector facilitates the possibility to pump produced liquids into well bore simultaneously with lifting gas.

(c) Produced hydrocarbons are not contaminated by any additives and are ready to be sold or sent into a field's gathering net.

(d) Formation fluid flow rates are kept substantially stable while drilling and making drill string connections. It not only creates better conditions for their utilization and disposal but facilitates using separating equipment of less volume and footprint.

(e) Connection time is dramatically decreased, and safety conditions on the rig floor improved by using the continuous flushing method of this invention.

It also will be will be appreciated by those skilled in the art that while flushing the well bore with formation fluid the well bore is being tested such that quantitative test results are readily available It is known that reverse circulation drilling under previous art a drill bit may be easily clogged with cuttings falling back while circulation is interrupted. It will be appreciated that by using continuous flushing system of the invention this disadvantage may be eliminated.

While the foregoing is directed to embodiments of the present invention, other and further embodiments of the invention may be devised without departing from the basic scope thereof, and the scope thereof is determined by the claims that follow.

I claim:

1. A method of drilling a well bore through and below a subterranean permeable formation bearing at least one of oil, gas, water, said method using a drilling rig, and a drill string having through bore and including interconnected joints of drill pipe, the method comprising: (a) providing a well bore casing at the top of said permeable formation (b) providing a rotating blow out preventer for controllably sealing the annulus between said casing and said drill string; (c) providing means for controllably producing the formation fluid through the drill string; (d) providing means for selectively separating at least drill cuttings from the wellhead stream comprising drill cuttings and at least one fluid; (e) drilling the well bore through said permeable formation, flushing the well bore with a drilling fluid being circulated from the surface until manifestations of the formation reach a predetermined value, said manifestations comprise lost circulation and influx of the formation fluid, (f) establishing a controllable flow of the formation fluid through the drill string at a predetermined rate said rate is at least sufficient for transporting drill cuttings to the surface through the drill string; (g) advancing the well bore while flushing it with the formation fluid being produced, such that formation fluid flows to the drill bit, picks drill cuttings up, and evacuates them through the through bore of the drill string to the surface; (h) operating said means for producing formation fluid, and controlling penetration rate such that formation fluid production rate remains substantially stable at a value at least sufficient for (trill cuttings evacuation; (i) pumping formation fluid, being produced while drilling, into casing/drill string annulus, enclosed with rotating BOP, at a rate ranging from 0 to 100% of the formation fluid production rate.

2. The method of claim 1 wherein said formation fluid is producible without assistance and said means for controllable production of the formation fluid comprise at least one valve in hydraulic communication with said through bore of the drill siring, and at least one flow line.

3. The method of claim 1 wherein said formation fluid is a liquid and said means for controllable production of the formation fluid through the drill string comprise a gas lift system including: (a) a source of a lifting gas at the surface (b) at least one lifting gas injector included in the drill string (a) a channel for delivering lifting gas to said lifting gas injector said channel comprising the casing-drill string annulus enclosed by rotating blowout preventer.

4. The method of claim 3 comprising a step of establishing and maintaining a pressure drop through the lifting gas injector within a predetermined range such that gas-liquid interface in the casing-drill string annulus remains below the injector at predetermined range of values, whereby drill cutting transport is not compromised by gas lift pulsations.

5. The method of claim 3 wherein the lifting gas injector comprises an inlet port adopted to be permeable for lifting gas and impermeable for a liquid at least while lifting gas is flowing through the injector, whereby it is possible to pump in one channel the lifting gas and the formation liquid being produced while drilling.

6. The method of claim 3 wherein a plurality of lifting gas injectors operable from the surface is included in the drill string, such that the first of them is in open position while being within an optimal for gas lift operation interval, and the second one is in closed position above the first, such that the second injector is opened by a signal from the surface when the first one reaches a predetermined depth, whereby interruption of drilling and partial drill string trips for setting the lifting gas injector in optimal interval are avoided.

7. The method of claim 1 wherein a system is provided for flushing the well bore while a drill pipe joint is being added to or removed from the drill string.

8. A method for flushing a well bore while a drill pipe joint is being added to or removed from a drill string, said drill string comprises interconnected joints of drill pipe, said well bore is being drilled Into the earth using a system comprising a drilling rig with a top drive/kelly for rotating a drill string, the method comprising steps of: (a) providing a plurality of three-way valves adopted for including in the drill string, each of said three way valves may be selectively set in a plurality of flow patterns, each of the valves comprises a side port adopted for temporarily securing a fluid conduit; (b) providing a bypass line for selectively connecting the side port of a three-way valve with a drilling fluid source and means for handling a wellhead flow; (c) including at least one of the three-way valves in the drill string such that said at least one valve is secured to the upper end of the drill string; (d) connecting the bypass line to the side port of the three-way valve located under a connection point of the drill string, and, by operating this valve and appropriate valves on connecting lines, having the flow of flushing fluid directed into the bypass line; (e) adding a drill pipe joint to or removing from the drill string while the well bore is being flushed through the bypass line.

9. The method of claim 8 further comprising steps of: (a) providing means for receiving fluids and drill cuttings being bled off from conduits while making a drill string connection; (b) providing a pressure release line adopted for temporarily connecting a three-way valve with means for receiving bleed off fluids and solids; (c) securing a three-way valve to the lower end of means for rotating the drill string; (d) connecting the bleed off line to the 3-way valve of said means for rotating the drill string and, by operating this valve, releasing the content cit lines above the valve into said means for receiving bleed of fluids and solids, whereby insuring the safety of the rig operators and environmentally friendly conditions as no fluids and solids are released at the rig floor while making connections.

10. A lifting gas injector for a gas lift system that may be employed to produce a formation liquid for flushing a well bore the well bore being drilled through and below a formation containing the formation liquid, the gas lift system comprising a drill string, a source of compressed lifting gas at the surface, at least one lifting gas injector included in the drill string, a channel for delivering lifting gas to the injector, said channel comprising casing-drill string annulus enclosed by rotating BOP, the lifting gas injector comprising: (a) tubular member adopted to be included in the drill string; (b) at least one of a plurality of openings in the wall of said tubular member for connecting casing/drill string annulus and the through bore of the drill string; (c) porous inserts adopted to be mounted into said openings in the wall of said tubular member such that one opening receives at least one insert, said porous inserts are characterized by coefficient of permeability of a porous material, by length of the insert, and by its area of filtration, whereby a pressure drop through the injector may be precisely regulated by at least one of (a) replacing at least one insert with another one with a different permeability, (b) replacing at least one insert by another one with a different length, (c) varying a filtration area of each insert, (d) varying cumulative filtration area of a plurality of said inserts.

11. The lifting gas injector of claim 10 wherein said permeable material of said porous inserts is permeable for lilting gas, but impermeable for a formation liquid, at least while the lifting gas flows through said insert, whereby it is possible to dispose formation liquid being produced while drilling by injecting it into the same channel and simultaneously with lifting gas.

12. The lifting gas injector of claim 11 wherein the tubular member with the wall openings is adopted for including in the drill string by providing a threaded box at one end of the member and a pin at the other such that in may be included in the drill string as a sub.

13. The lifting gas injector of claim 11 wherein the tubular member with the wall openings is adopted for including in the drill by mounting it into a side pocket of a side pocket sub such that the lifting gas injector includes said tubular member as a flow regulator and said side pocket sub.

14. The lifting gas injector as claimed in claim 13 wherein said side pocket sub comprises a tubular member with a threaded box at one end and a pin at the other; a laterally inset side pocket for mounting said flow regulator; at least one bore in the wall of the side pocket for connecting time flow chamber of the regulator and the central passage way of the sub.

15. The lifting gas injector of claim 13 wherein the flow regulator comprises a check valve, whereby it is possible to include the lifting gas injector in the drill string in advance and to drill with direct circulation of a drilling fluid.

16. The lifting gas injector of claim 15 wherein the flow regulator further comprises a piston, the piston being selectively moved may alter the filtration area of the inlet port so the pressure drop through the injector may be regulated.

17. The lifting gas injector of claim 16 wherein said flow regulator further comprises: (a) an electric motor, (b) a battery, (c) at least one sensor for receiving signals from a commanding device at the surface; (d) a single-axis motion means including one of the group comprising a leading screw and nut assembly, rack and pinion assembly, a solenoid, a hydraulically extendable cylinder, said means may be operatively connected to said electric motor for moving said piston, (e) an electronic controller for actuating the motor in accordance with signals of said at least one sensor; whereby it is possible to include the injector in the drill string in closed position, to open it and tune it up by coded signals from the surface.

18. The lifting gas injector of claim 17 wherein said leading screw and nut assembly comprises: (a) a sleeve affixed to the upper end of the piston, (b) a nut at it the upper end of the sleeve (c) a flat member affixed to the nut and placed into and movable along a slot in the inside wall of the flow regulator (d) a screw with a head (e) a hole of such shape in the screw head that the screw may be rotated by a shaft of the motor placed into the hole, (f) a supporting hearing placed on a shelve inside the flow regulator such that the head of the screw is secured in the upper ring of the bearing; whereby the piston may be selectively moved, potential damage to the motor by a downward force, created by a difference in lifting gas pressure below and above the piston, may be avoided, and energy needs of the motor are decreased.

* * * * *